US011398685B2

(12) United States Patent
Boegl

(10) Patent No.: US 11,398,685 B2
(45) Date of Patent: Jul. 26, 2022

(54) ANTENNA SYSTEM AND ANTENNA CONTROLLING METHOD

(71) Applicant: Rohde & Schwarz GmbH & Co. KG, Munich (DE)

(72) Inventor: Thomas Boegl, Augsburg (DE)

(73) Assignee: ROHDE & SCHWARZ GMBH & CO. KG, Munich (DE)

( * ) Notice: Subject to any disclaimer, the term of this patent is extended or adjusted under 35 U.S.C. 154(b) by 0 days.

(21) Appl. No.: 16/945,258

(22) Filed: Jul. 31, 2020

(65) Prior Publication Data

US 2021/0119349 A1 Apr. 22, 2021

(30) Foreign Application Priority Data

Oct. 18, 2019 (EP) ..... 19204009

(51) Int. Cl.
*H01Q 21/29* (2006.01)
*H01Q 1/24* (2006.01)
*H01Q 21/20* (2006.01)

(52) U.S. Cl.
CPC ..... *H01Q 21/293* (2013.01); *H01Q 1/246* (2013.01); *H01Q 21/20* (2013.01); *H01Q 21/29* (2013.01)

(58) Field of Classification Search
CPC ..... H01Q 21/20; H01Q 21/29; H01Q 21/065; H01Q 21/293; H01Q 1/246; H01Q 3/2652; H01Q 9/0464; H01Q 3/01; H01Q 5/48; H01Q 5/321; H01Q 3/38; H01Q 9/0442; H01Q 3/242
See application file for complete search history.

(56) References Cited

U.S. PATENT DOCUMENTS

| | | | | |
|---|---|---|---|---|
| 2,465,353 A * | 3/1949 | Chesus | G01S 1/02 342/441 |
| 2,586,342 A * | 2/1952 | Jarvis | G01S 3/42 342/434 |
| 2,994,871 A * | 8/1961 | Troost | G01S 3/08 342/445 |
| 3,035,265 A | 5/1962 | Gunther et al. | |
| 3,623,116 A | 11/1971 | Green et al. | |
| 3,710,333 A | 1/1973 | Crom | |
| 3,795,001 A | 2/1974 | Poppe et al. | |
| 3,852,753 A | 12/1974 | Blakemore | |
| 3,924,236 A | 12/1975 | Earp et al. | |
| 4,203,114 A | 5/1980 | Gerst et al. | |
| 4,833,478 A | 5/1989 | Nossen | |
| 5,122,807 A | 6/1992 | Trask et al. | |

(Continued)

FOREIGN PATENT DOCUMENTS

| | | |
|---|---|---|
| BR | 112014033119 A2 | 6/2017 |
| CN | 206362920 U | 7/2017 |

(Continued)

*Primary Examiner* — Vibol Tan
(74) *Attorney, Agent, or Firm* — Ditthavong, Steiner & Mlotkowski

(57) ABSTRACT

An antenna system is provided. The antenna system comprises at least two antenna elements. In this context, the at least two antenna elements are arranged around an inner diameter. In addition to this, each of the at least two antenna elements is configured to be controlled separately from each other. Exemplarily, each of the at least two antenna elements is connected to a corresponding amplifier.

13 Claims, 9 Drawing Sheets

(56) References Cited

U.S. PATENT DOCUMENTS

| | | | | |
|---|---|---|---|---|
| 5,461,387 | A | 10/1995 | Weaver | |
| 5,530,452 | A | 6/1996 | Yokev et al. | |
| 5,812,220 | A | 9/1998 | Weiss et al. | |
| 5,969,689 | A | 10/1999 | Martek et al. | |
| 6,021,096 | A | 2/2000 | Schlieter et al. | |
| 6,104,346 | A | 8/2000 | Rudish et al. | |
| 6,178,140 | B1 | 1/2001 | Schlieter | |
| 6,249,261 | B1 | 6/2001 | Solberg et al. | |
| 6,421,010 | B1 | 7/2002 | Chadwick et al. | |
| 6,670,920 | B1 | 12/2003 | Herrick | |
| 6,864,852 | B2 * | 3/2005 | Chiang | H01Q 1/246 343/817 |
| 7,380,455 | B2 | 6/2008 | Workman | |
| 7,408,509 | B2 | 8/2008 | Karlsson et al. | |
| 7,750,849 | B2 | 7/2010 | Hjelmstad | |
| 7,978,139 | B2 | 7/2011 | Robinson et al. | |
| 8,989,683 | B2 * | 3/2015 | Actis | H03G 3/3042 455/127.1 |
| 9,057,776 | B1 | 6/2015 | Wernicke | |
| 9,310,458 | B2 | 4/2016 | Lee et al. | |
| 9,374,673 | B2 | 6/2016 | Mendelson | |
| 9,384,648 | B2 | 7/2016 | Yan et al. | |
| 9,651,652 | B2 | 5/2017 | Kpodzo et al. | |
| 9,995,817 | B1 | 6/2018 | Mittiga | |
| 10,770,790 | B1 * | 9/2020 | Mahanfar | H01Q 19/062 |
| 2004/0027304 | A1 * | 2/2004 | Chiang | H01Q 21/205 343/810 |
| 2012/0020431 | A1 | 1/2012 | Tanabe | |
| 2018/0052215 | A1 | 2/2018 | Strobel | |
| 2018/0123238 | A1 | 5/2018 | Fenn et al. | |
| 2019/0025801 | A1 | 1/2019 | Suzuki et al. | |
| 2019/0252801 | A1 * | 8/2019 | Mahanfar | H01Q 3/26 |

FOREIGN PATENT DOCUMENTS

| | | | |
|---|---|---|---|
| DE | 2552532 | A1 | 5/1977 |
| DE | 3021406 | A1 | 12/1981 |
| DE | 69223405 | T2 | 4/1998 |
| DE | 19648327 | B4 | 6/1998 |
| DE | 102004033375 | B4 | 7/2010 |
| EP | 0583523 | A2 | 2/1994 |
| EP | 2725384 | B1 | 12/2015 |
| EP | 2294440 | B1 | 2/2019 |
| EP | 1873551 | B1 | 3/2019 |
| FI | 85427 | C | 4/1992 |
| FR | 2156188 | B1 | 4/1977 |
| FR | 2137606 | B1 | 5/1978 |
| GB | 2049296 | B | 1/1983 |
| GB | 2232843 | A | 12/1990 |
| GB | 2243041 | B | 2/1994 |
| GB | 2403853 | A | 1/2005 |
| IT | 1025982 | B | 8/1978 |
| IT | 1124647 | B | 5/1986 |
| JP | 61003077 | A | 1/1986 |
| JP | 63214005 | A | 9/1988 |
| JP | 63254888 | A | 10/1988 |
| JP | 0489588 | A | 3/1992 |
| JP | 6222124 | A | 8/1994 |
| JP | 08129059 | A | 5/1996 |
| JP | 2787586 | B2 | 8/1998 |
| JP | 2973019 | B2 | 11/1999 |
| JP | 2973021 | B2 | 11/1999 |
| JP | 3619081 | B2 | 2/2005 |
| JP | 1112726 | B2 | 7/2008 |
| KR | 20120009878 | A | 2/2012 |
| KR | 101126158 | B1 | 3/2012 |
| TW | 201126189 | A | 8/2011 |
| WO | 2004093245 | A3 | 8/2007 |
| WO | 2014007686 | A1 | 1/2014 |
| WO | 2018089082 | A1 | 5/2018 |

* cited by examiner

ANTENNA SYSTEM AND ANTENNA CONTROLLING METHOD

PRIORITY

This application claims priority of European Patent Application EP 19 204 009.5 filed on Oct. 18, 2019, which is incorporated by reference herewith.

FIELD OF THE INVENTION

The invention relates to an antenna system and an antenna controlling method, which especially allow for beam steering.

BACKGROUND OF THE INVENTION

Generally, in times of an increasing number of applications providing wireless communication capabilities, there is a growing need of an antenna system and an antenna controlling method, which especially allow for a reduction or suppression of emissions in undesired directions.

Unfortunately, neither an antenna system nor an antenna controlling method is know, which especially allow for selecting individual radiation characteristics for several users at the same antenna in either transmit or receive direction.

Accordingly, there is a need to provide an antenna system and an antenna controlling method, which especially allow for beam steering, preferably active beam steering, thereby ensuring a high efficiency and an enlarged transmission range.

There is a need by the features of claim 1 for an antenna system and the features of claim 14 for an antenna controlling method. The dependent claims contain further developments.

SUMMARY OF THE INVENTION

According to a first aspect of the invention, an antenna system is provided. The antenna system comprises at least two antenna elements. In this context, the at least two antenna elements are arranged around an inner diameter. In addition to this, each of the at least two antenna elements is configured to be controlled separately from each other. Advantageously, for instance, emissions in undesired directions can be reduced or even suppressed.

According to a first preferred implementation form of the first aspect of the invention, each of the at least two antenna elements is configured to receive signals separately from each other. Advantageously, for example, efficiency can further be increased.

In addition to this or as an alternative, each of the at least two antenna elements is configured to transmit signal separately from each other. Advantageously, for instance, efficiency can further be increased.

According to a second preferred implementation form of the first aspect of the invention, the antenna system further comprises at least two amplifiers. In this context, each of the at least two antenna elements is connected to a corresponding one of the at least two amplifiers.

Advantageously, for example, transmission range can be enlarged in an efficient manner.

According to a further preferred implementation form of the first aspect of the invention, the number of the amplifiers is equal to the number of the antenna elements. Advantageously, for instance, complexity can be reduced, thereby increasing efficiency.

According to a further preferred implementation form of the first aspect of the invention, the antenna system further comprises a multi-channel amplifier. In this context, each of the at least two antenna element is connected to a corresponding channel of the multi-channel amplifier. Advantageously, for example, complexity can further be reduced, which leads to an increased efficiency.

According to a further preferred implementation form of the first aspect of the invention, the number of channels of the multi-channel amplifier is equal to the number of the antenna elements. Advantageously, for instance, efficiency can further be increased.

According to a further preferred implementation form of the first aspect of the invention, the at least two antenna elements are arranged around the inner diameter in a circular manner. Advantageously, for example, complexity can further be reduced, thereby ensuring an increased efficiency.

According to a further preferred implementation form of the first aspect of the invention, the antenna system is configured to actively steer the respective beams of the at least two antenna elements. Advantageously, for example, emissions in undesired directions can further be reduced, thereby reducing probability of detection from other directions.

According to a further preferred implementation form of the first aspect of the invention, the antenna system is configured to support a direction finder unit especially being distant from the antenna system. Advantageously, for instance, a direction finding can be performed in an efficient manner. Further advantageously, the direction finder unit may preferably be connected to the antenna system.

According to a further preferred implementation form of the first aspect of the invention, the antenna system is configured to detect a receive signal direction by supporting the direction finder unit. Advantageously, for example, a direction finding can be performed in a highly accurate manner. Further advantageously, the antenna system may especially allow for parallel listening.

According to a further preferred implementation form of the first aspect of the invention, in transmission operation mode, the antenna system is configured to reroute the available transmission power of inactive antenna elements of the at least two antenna elements to active antenna elements of the at least two antenna elements. Advantageously, for instance, the respective transmission range can be enlarged in a highly efficient manner.

According to a further preferred implementation form of the first aspect of the invention, the antenna system is configured to equally distribute the available transmission power to the active antenna elements. Advantageously, for example, complexity can be reduced.

According to a further preferred implementation form of the first aspect of the invention, the antenna system comprises four, preferably eight, antenna elements. Advantageously, for instance, efficiency can further be increased.

According to a second aspect of the invention, an antenna controlling method is provided. The antenna controlling method comprises the steps of arranging at least two antenna elements around an inner diameter, and controlling each of the at least two antenna elements separately from each other. Advantageously, for example, emissions in undesired directions can be reduced or even suppressed.

BRIEF DESCRIPTION OF THE DRAWINGS

Exemplary embodiments of the invention are now further explained with respect to the drawings by way of example only, and not for limitation. In the drawings.

DETAILED DESCRIPTION OF PREFERRED EMBODIMENTS

Figure 1:
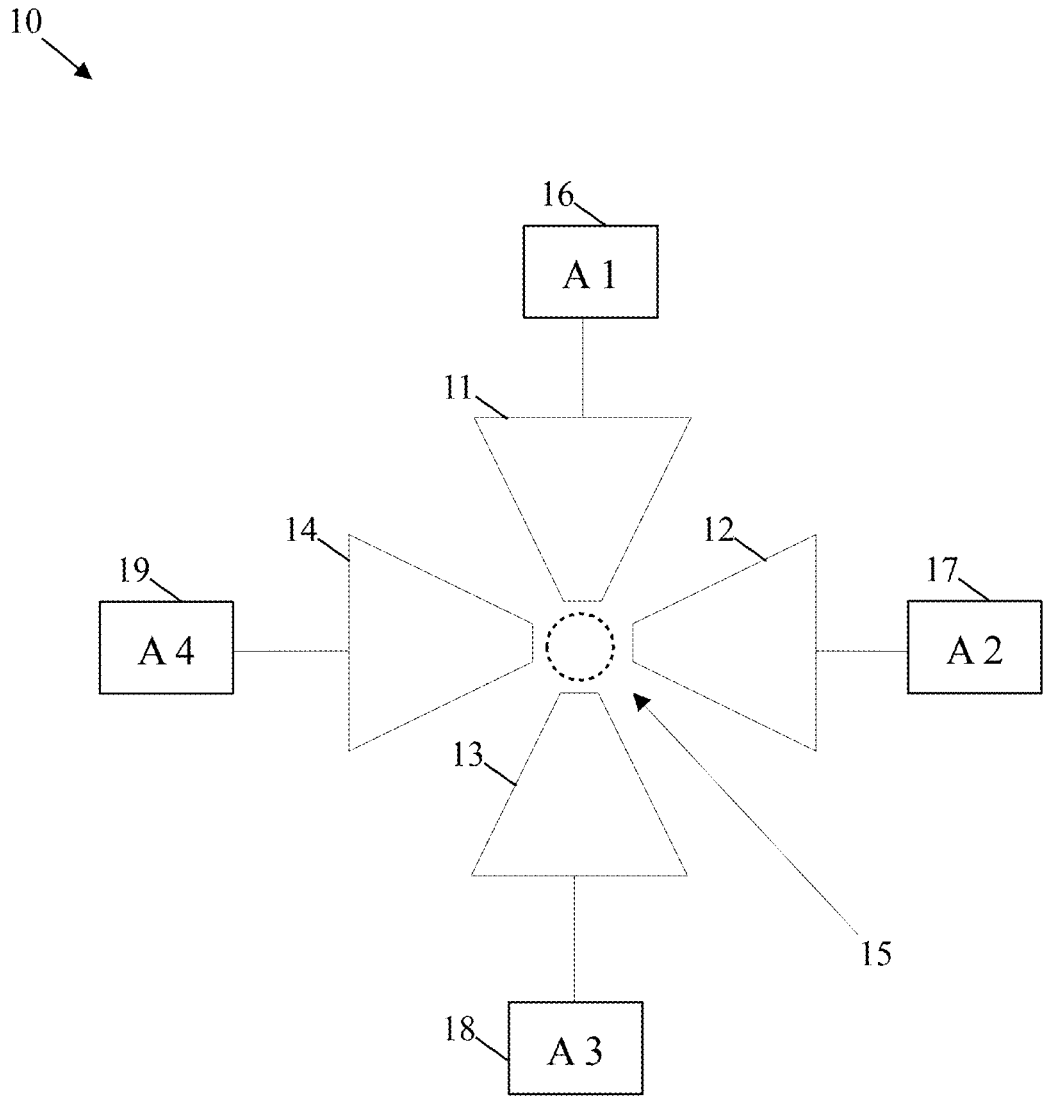
FIG. 1 shows a first embodiment of the first aspect of the invention.

FIG. 1 illustrates a first embodiment 10 of the inventive antenna system. The antenna system 10 comprises at least two antenna elements, exemplarily the four antenna elements 11, 12, 13, 14, and at least two amplifiers, exemplarily the four amplifiers 16, 17, 18, 19.

In this context, the antenna elements 11, 12, 13, 14 are arranged around an inner diameter 15. Additionally, each of the four antenna elements 11, 12, 13, 14 is configured to be controlled separately from each other. In further addition to this, each of the four antenna elements 11, 12, 13, 14 is connected to a corresponding one of the four amplifiers 16, 17, 18, 19.

It is noted that it might be particularly advantageous if each of the four antenna elements 11, 12, 13, 14 is configured to receive signals separately from each other. In addition to this or as an alternative, each of the four antenna elements 11, 12, 13, 14 may be configured to transmit signal separately from each other.

As it can further be seen from FIG. 1, the four antenna elements 11, 12, 13, 14 are arranged around the inner diameter 15 in a circular manner. It is further noted that it might be particularly advantageous if the antenna system 10 is configured to actively steer the respective beams of the four antenna elements 11, 12, 13, 14.

Moreover, especially in transmission operation mode, the antenna system 10 may be configured to reroute the available transmission power of inactive antenna elements of the four antenna elements 11, 12, 13, 14 to active antenna elements of the four antenna elements 11, 12, 13, 14. In this context, the antenna system 10 may further be configured to equally distribute the available transmission power to the active antenna elements.

Figure 2:
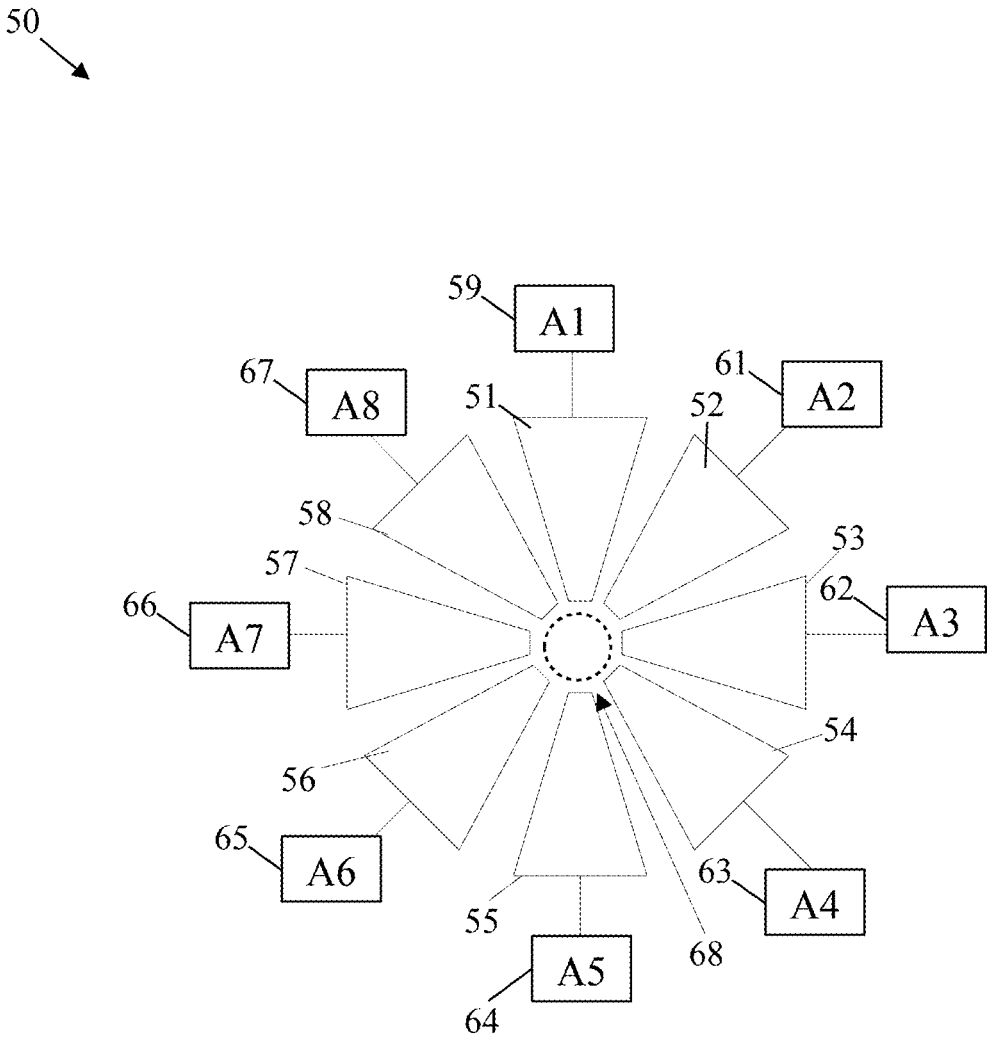
FIG. 2 shows a second embodiment of the first aspect of the invention.

Furthermore, FIG. 2 depicts a second embodiment 50 of the inventive antenna system. The antenna system 50 comprises eight antenna elements 51, 52, 53, 54, 55, 56, 57, 58, and eight amplifiers 59, 61, 62, 63, 64, 65, 66, 67.

In this context, the antenna elements 51, 52, 53, 54, 55, 56, 57, 58 are arranged around an inner diameter 68. Additionally, each of the eight antenna elements 51, 52, 53, 54, 55, 56, 57, 58 is configured to be controlled separately from each other. In further addition to this, each of the eight antenna elements 51, 52, 53, 54, 55, 56, 57, 58 is connected to a corresponding one of the eight amplifiers 59, 61, 62, 63, 64, 65, 66, 67.

It is noted that it might be particularly advantageous if each of the eight antenna elements 51, 52, 53, 54, 55, 56, 57, 58 is configured to receive signals separately from each other. In addition to this or as an alternative, each of the eight antenna elements 51, 52, 53, 54, 55, 56, 57, 58 may be configured to transmit signal separately from each other.

As it can further be seen from FIG. 2, the eight antenna elements 51, 52, 53, 54, 55, 56, 57, 58 are arranged around the inner diameter 68 in a circular manner. It is further noted that it might be particularly advantageous if the antenna system 50 is configured to actively steer the respective beams of the eight antenna elements 51, 52, 53, 54, 55, 56, 57, 58.

Moreover, especially in transmission operation mode, the antenna system 50 may be configured to reroute the available transmission power of inactive antenna elements of the eight antenna elements 51, 52, 53, 54, 55, 56, 57, 58 to active antenna elements of the eight antenna elements 51, 52, 53, 54, 55, 56, 57, 58. In this context, the antenna system 50 may further be configured to equally distribute the available transmission power to the active antenna elements.

Figure 3:
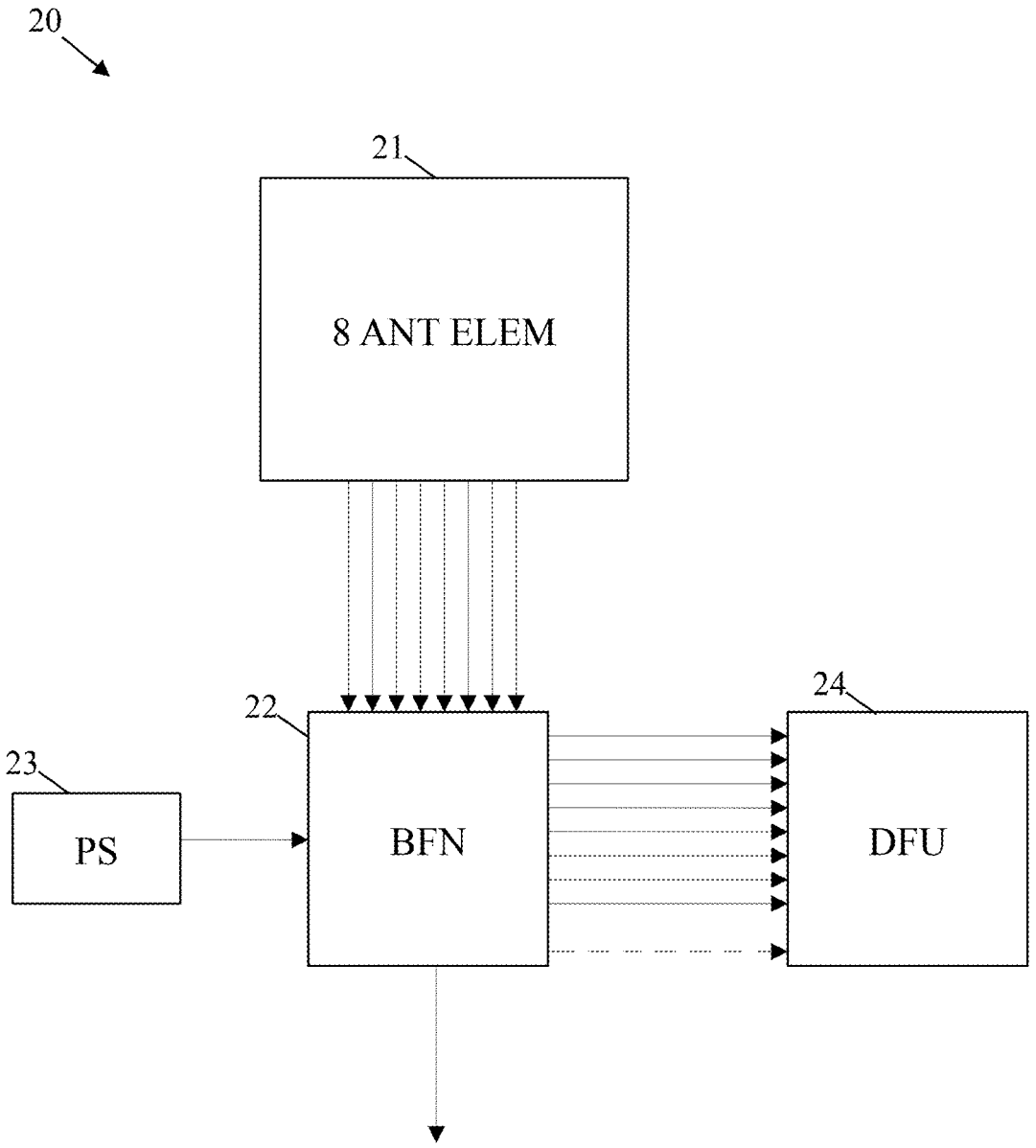
FIG. 3 shows a third embodiment of the first aspect of the invention especially comprising a beam forming network.

Now, with respect to FIG. 3, a third exemplary embodiment 20 of the inventive antenna system is shown. The system 20 comprises eight antenna elements 21 arranged in accordance with FIG. 2. Said eight antenna elements 21 are connected to a beam forming network 22, wherein the beam forming network 22 is connected to a power supply 23.

Moreover, the antenna system 20, preferably with the aid of the beam forming network 22, is configured to support, preferably control, a direction finder unit 24 especially being distant from the antenna system 20. In this context, the antenna system 20, preferably with the aid of the beam forming network 22, may be configured to detect a receive signal direction by supporting, preferably controlling, the direction finder unit 24.

With respect to the beam forming network 22, it is noted that the beam forming network 22 according to FIG. 3 may comprise an eight-channel amplifier (one amplifier for each antenna element).

The beam forming network 22 may further comprise a 2:1-combiner after each amplifier or in each channel, respectively, especially for splitting the respective signal with respect to a corresponding communication network and a corresponding direction finding network. Additionally, the beam forming network 22 may further comprise a 8:1-combiner for a respective communication receive output. As it can further be seen from FIG. 3, the beam forming network 22 comprises an eight-channel output for the direction finder unit 24.

Optionally, as illustrated by the respective dotted line, the beam forming network 22 may comprise a sum output for the direction finder unit 24.

It is generally noted that the invention is not limited to the foregoing or the following embodiments. In this context, it is to be pointed out that especially in the case of n antenna elements, the characteristics of the respective components such as the number of channels of a multi-channel amplifier of the antenna system are to be adapted accordingly. Such embodiments are also covered by the invention.

Figure 4:
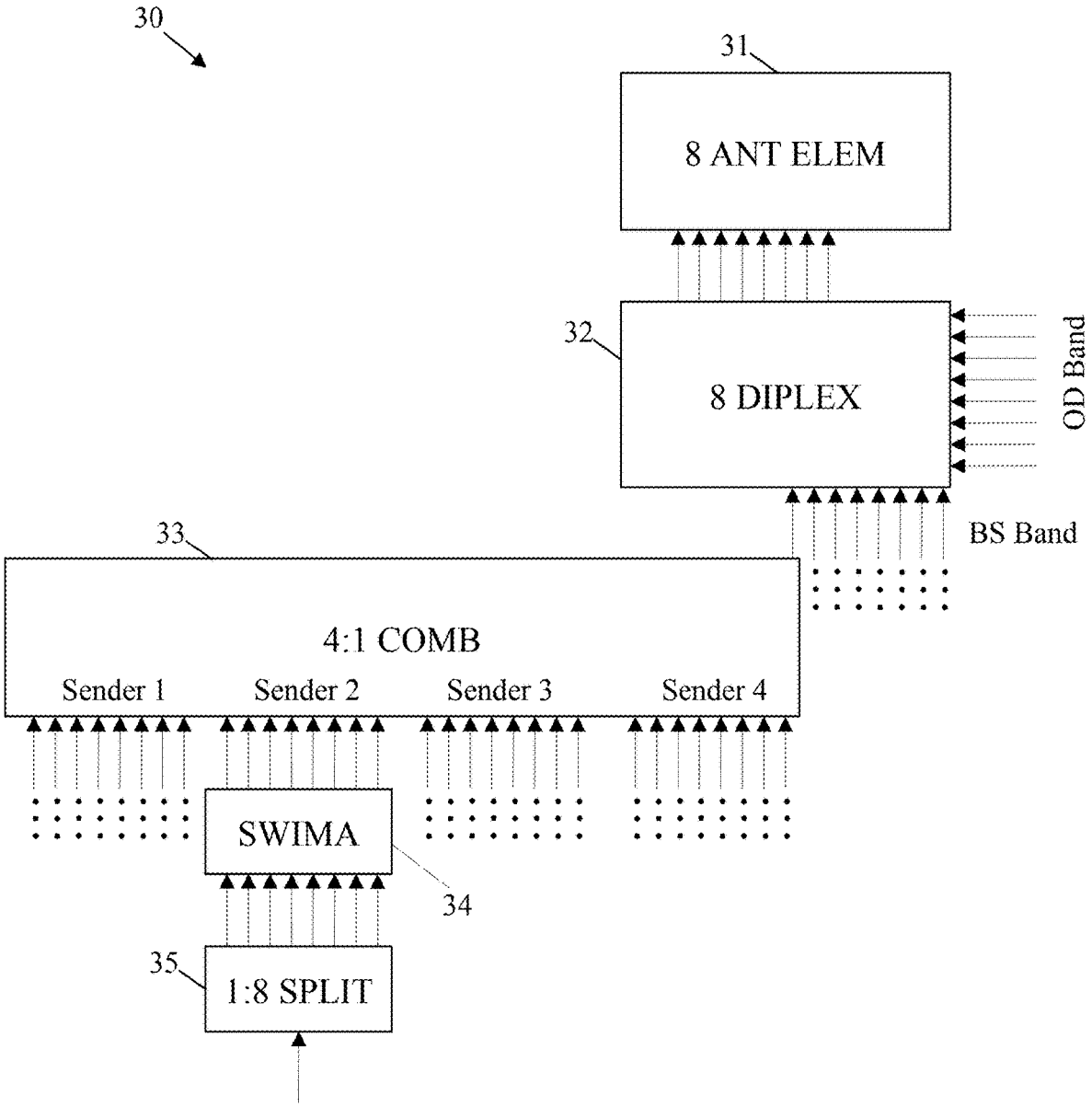
FIG. 4 shows a fourth embodiment of the first aspect of the invention especially for coupling multiple transmitters.

Furthermore, FIG. 4 depicts a fourth embodiment 30 of the inventive especially for coupling multiple, exemplarily four, transmitters or senders. In this context, eight antenna elements 31 arranged according to FIG. 2 are connected to eight diplexers 32 (one separate duplexer for each antenna element). The diplexers 32 are configured to couple in two different frequency bands. Said frequency bands comprise an omnidirectional (OD) frequency band and a beam steering (BS) frequency band.

Within the omnidirectional frequency band, the antenna system 30 is configured to allow for an omnidirectional emission, especially an isotropic emission. Within the beam steering frequency band, the antenna system 30 is configured to allow for a directed emission preferably based on beam steering.

The omnidirectional frequency band may comprise a very high frequency (VHF) band, preferably a frequency range from 100 MHz to 174 MHz, more preferably a frequency range from 100 MHz to 163 MHz. The beam steering frequency band may comprise an ultra high frequency band (UHF), preferably a frequency range from 225 MHz to 400 MHz.

Moreover, each of the eight diplexers is connected to a respective 4:1-combiner (one of which is exemplarily illustrated by the 4:1-combiner 33) for connecting the above-mentioned four transmitters or senders. In addition to this, each of the four transmitters or senders is connected to the respective 4:1-combiner via a respective 1:8-splitter (one of which is exemplarily illustrated by the 1:8-splitter 35) and a respective switch matrix (one of which is exemplarily illustrated by the switch matrix 34), especially wherein the respective switch matrix is directly connected to the respective 4:1-combiner. With respect to the 1:8-splitters, it is noted that each of the 1:8-splitters may preferably comprise eight amplifiers (one for each antenna element).

Figure 5:
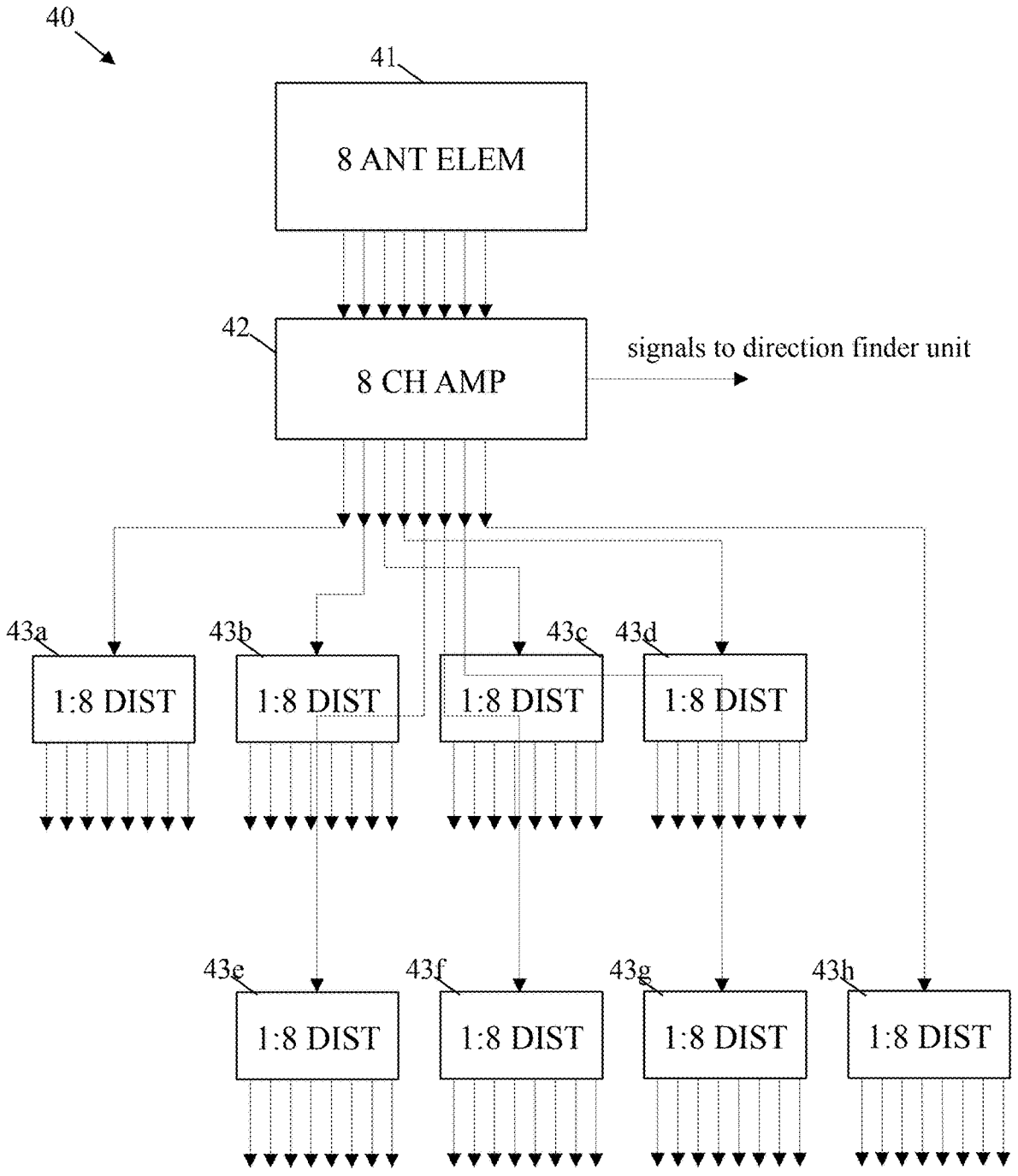
FIG. 5 shows a fifth embodiment of the first aspect of the invention especially for allowing beam forming with respect to the receiving direction.

Now, with respect to FIG. 5 a fifth exemplary embodiment 40 of the inventive antenna system is shown, which especially allows for extending beam forming with respect to the receive direction.

As it can be seen from FIG. 5, the antenna system 40 comprises eight antenna elements 41 arranged in accordance with FIG. 2. Said eight antenna elements 41 are connected to an eight-channel amplifier 42, which especially allows for low noise and high linearity. Furthermore, each of the eight channels of the eight-channel amplifier 42 is connected to a respective 1:8-distributor 43*a*, 43*b*, 43*c*, 43*d*, 43*e*, 43*f*, 43*g*, 43*h*. It is further noted that the eight-channel amplifier 42 is especially configured to provide signals to a direction finder unit such as the direction finder unit 24 according to FIG. 3.

Figure 6:
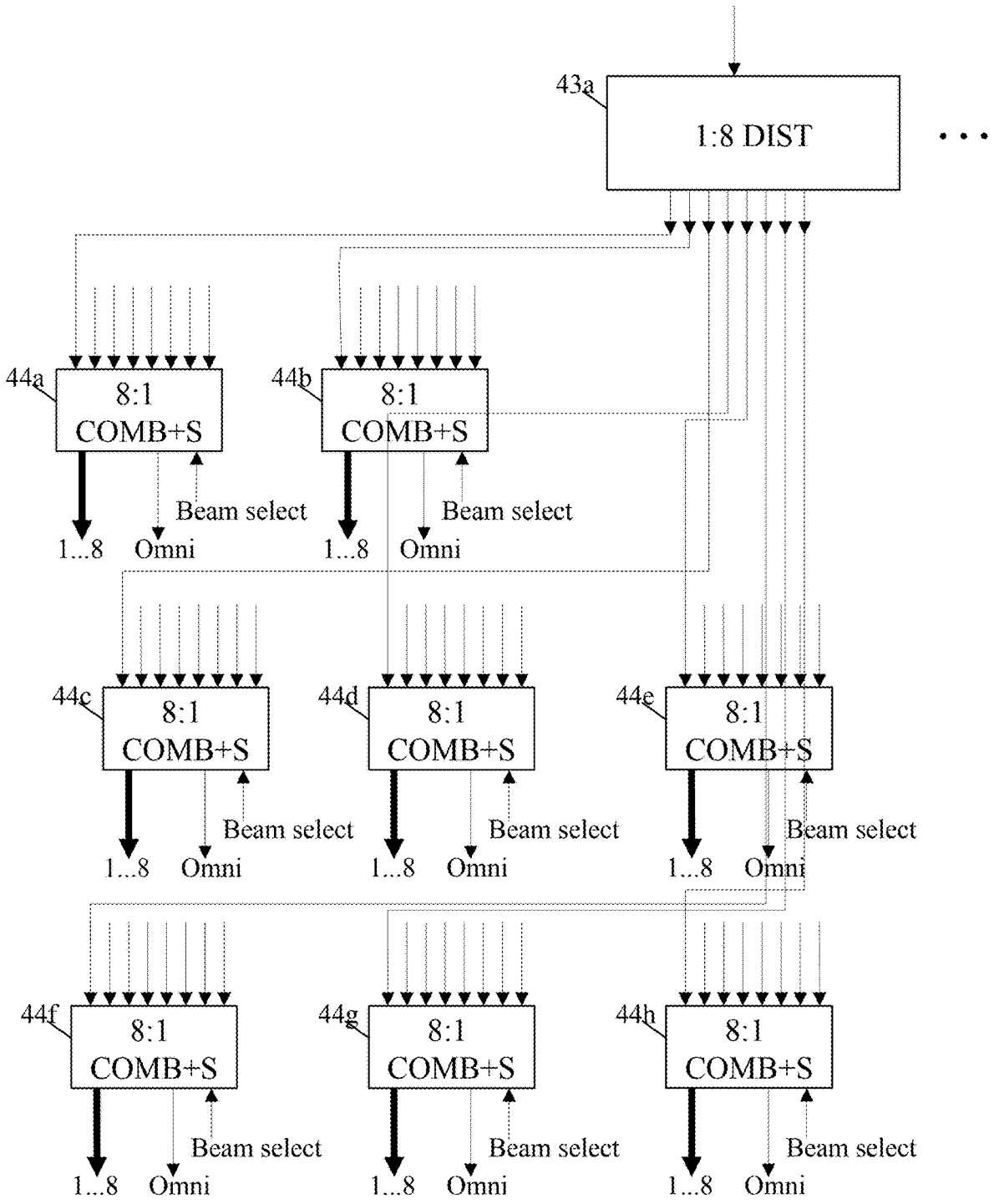
FIG. 6 shows an extension of the fifth embodiment of the first aspect of the invention.

In addition to this, in accordance with FIG. 6, each of the 1:8-distributors 43*a*, 43*b*, 43*c*, 43*d*, 43*e*, 43*f*, 43*g*, 43*h* may be connected to the respective input of eight 8:1-combiners 44*a*, 44*b*, 44*c*, 44*d*, 44*e*, 44*f*, 44*g*, 44*h*, each of which comprises an antenna element selecting switch for selecting the desired beam or beams, which is illustrated with the aid of a "Beam select"-input of the 8:1-combiners 44*a*, 44*b*, 44*c*, 44*d*, 44*e*, 44*f*, 44*g*, 44*h*. Moreover, each of the 8:1-combiners 44*a*, 44*b*, 44*c*, 44*d*, 44*e*, 44*f*, 44*g*, 44*h* is adapted to output the signals with respect to the eight antenna elements 41 and to output a respective omnidirectional signal.

Now, with respect to each of the foregoing embodiments 10, 20, 30, 40, 50 of the inventive antenna system, it is noted that the inventive antenna element arrangement may advantageously allow for an omnidirectional antenna diagram especially without arranging the respective antenna at the top of the corresponding mast.

It is noted that it might be particularly advantageous if the invention or the inventive antenna system, respectively, is used for vessels, especially ships.

Additionally, with special respect to the receive direction, the inventive antenna system allows for a direction finding function. In addition to this, the directivity of the respective radio communication routes is independent for multiple subscribers. Further additionally, with special respect to the transmission direction, the inventive antenna system allows for selecting the radiation direction for multiple radio communication routes simultaneously and independently from each other.

Figure 7:
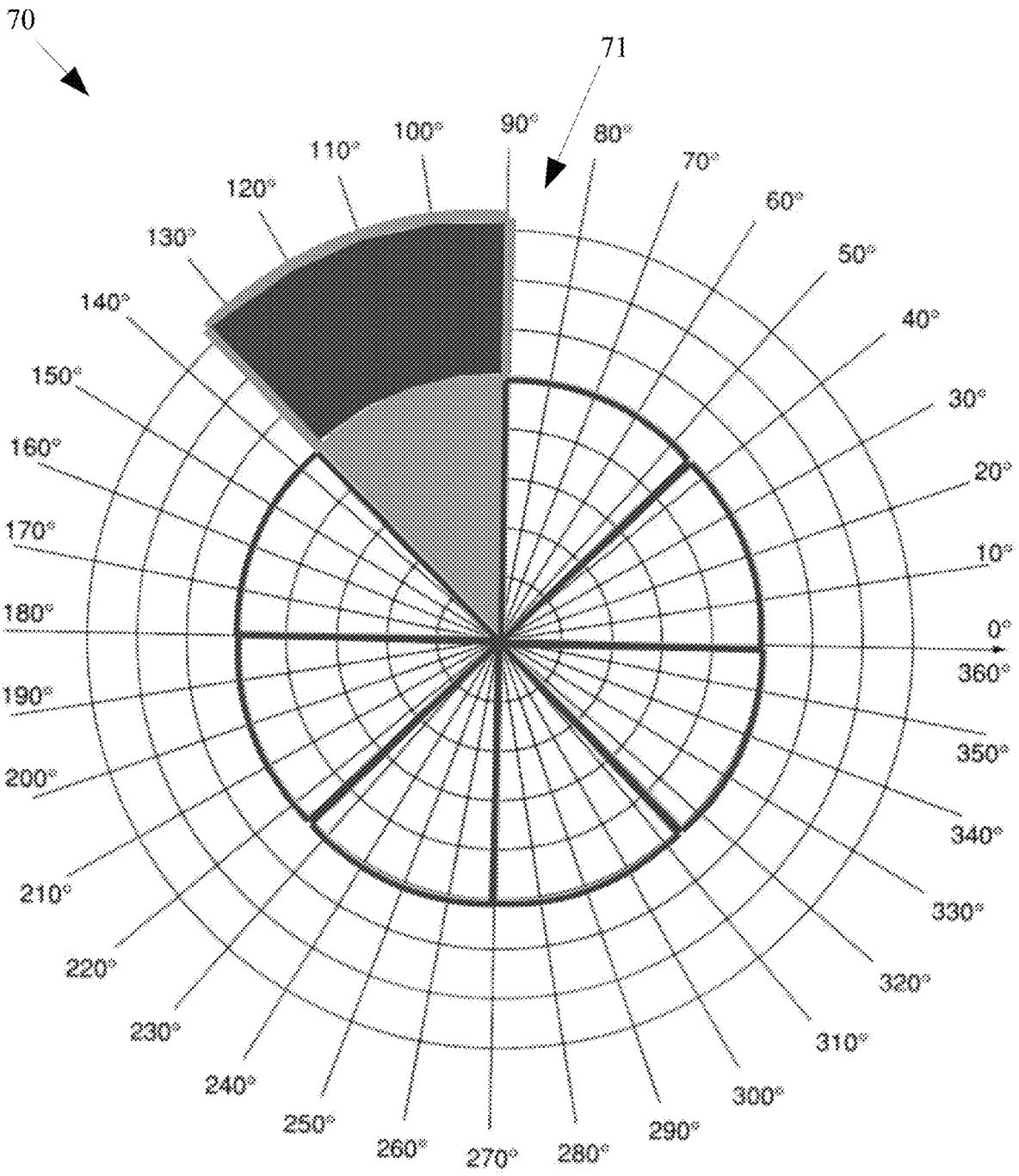
FIG. 7 shows an exemplary radiation diagram regarding active beam steering in transmitting direction.

With respect to FIG. 7, an exemplary radiation diagram 70 is shown. In this context, it is noted that the invention may generally provide the advantage of an omnidirectional antenna diagram. Further advantageously, for providing the omnidirectional antenna diagram, the antenna or the antenna arrangement, respectively, has not to be arranged on the top of the corresponding mast. It is further noted that the inventive antenna system or the antenna arrangement, respectively, may especially behave as an omnidirectional dipole. With the aid of the marked sector 71, FIG. 7 illustrates active beam steering in transmission direction.

With general respect to the respective radio lines, it is noted that each of the respective radio lines can independently and/or simultaneously change its radiation characteristic with respect to the remaining radio lines.

In this context, each of the respective radio lines may allow, especially always allow, for an omnidirectional radiation characteristic. Furthermore, each of the respective radio lines may control any of the antenna elements. It is noted that the invention or the inventive antenna system, respectively, may especially allow for sectoral radiation. Additionally, the remaining and especially inactive antenna elements may be switched off.

In this context, the corresponding power of the inactive antenna elements may preferably be added up and be used for the active antenna element.

Exemplarily, in the case of one active antenna element or sector, respectively, and seven inactive antenna elements or sectors, respectively, the respective antenna gain may be increased by 8 to 9 dB.

Figure 8:
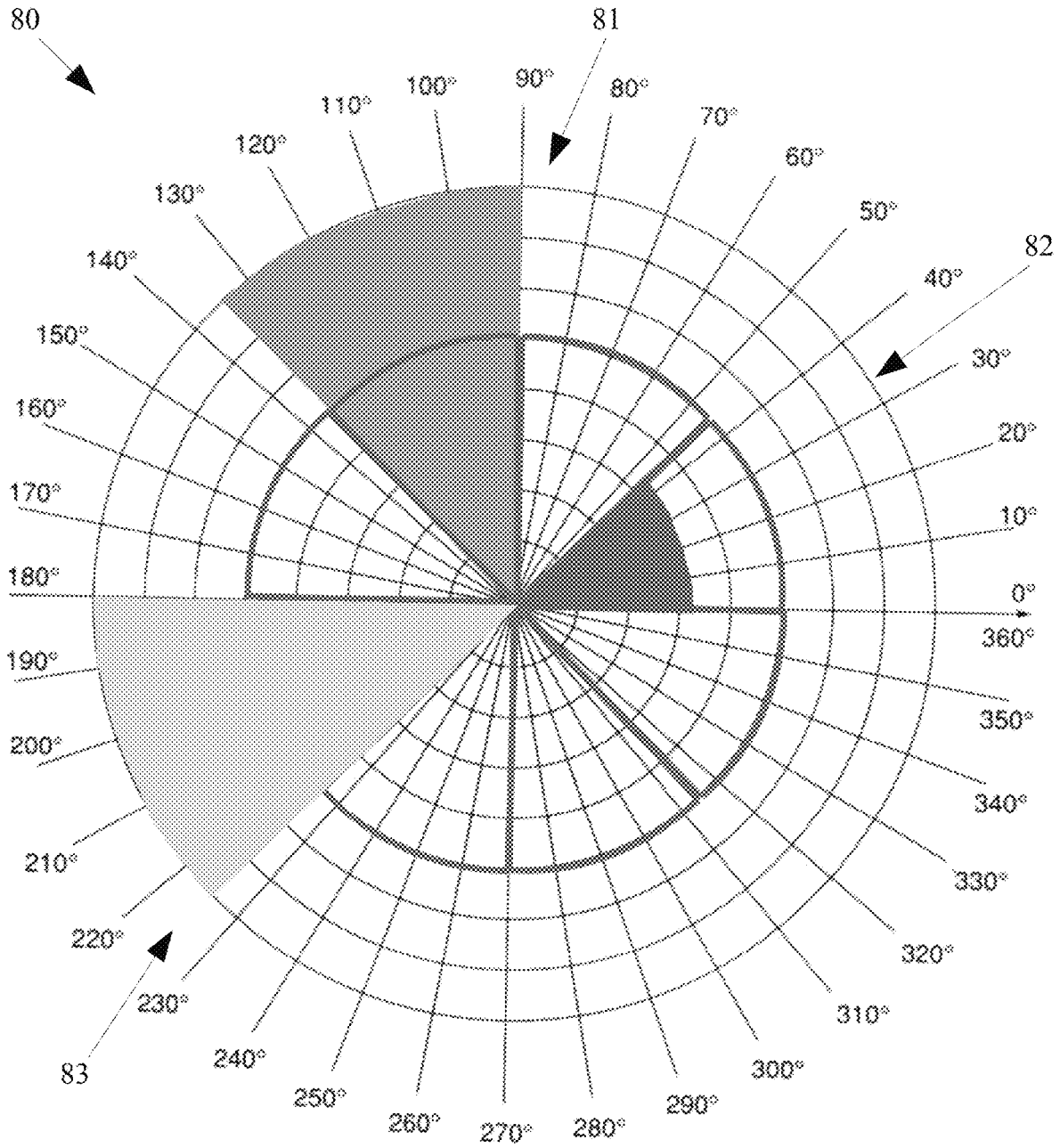
FIG. 8 shows an exemplary radiation diagram regarding four independent radio lines.

Moreover, FIG. 8 depicts an exemplary radiation diagram 80 with respect to four independent radio lines. In this context, three different sectors 81, 82, 83 are exemplarily marked.

It is generally noted that the radiation diagram may be different with respect to the above-mentioned omnidirectional frequency band and beam steering frequency band.

With general respect to the invention and the receiving direction, it is noted that the invention may allow for direction finding. It is further noted that the invention may allow for an independent directivity of the respective radio lines especially for multiple subscribers.

Furthermore, with general respect to the invention and the transmission direction, it is noted that the invention may allow for an independent and/or simultaneous selection of the transmitting direction with respect to multiple radio lines.

Figure 9:
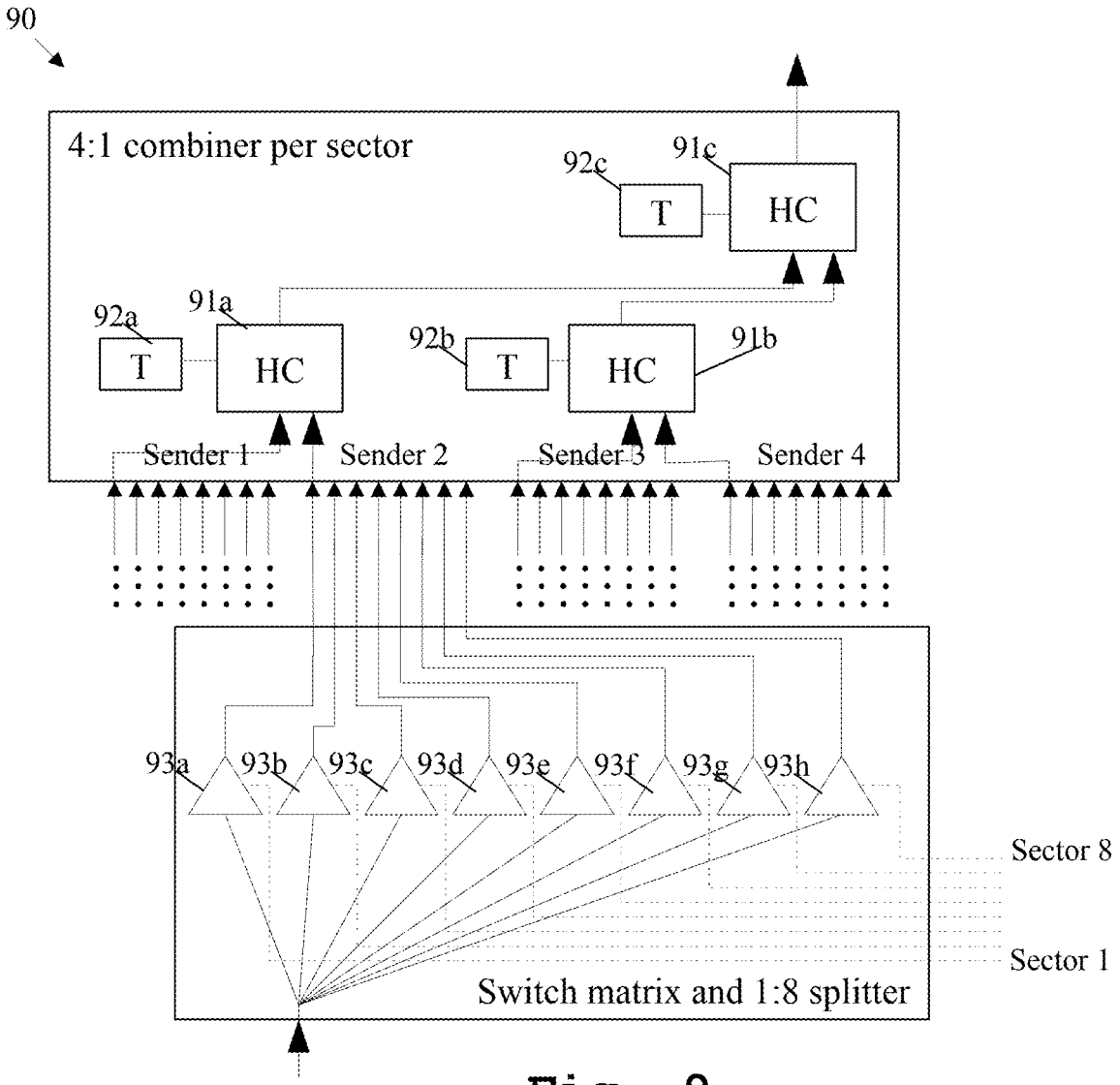
FIG. 9 shows an exemplary embodiment of a part of the fourth embodiment of the first aspect of the invention in greater detail.

Now, with respect to FIG. 9, an exemplary embodiment 90 of a part of the fourth embodiment of the first aspect of the invention is illustrated in greater detail. In this context, especially the parts with reference signs 33, 34, and 35 according to FIG. 4 are shown in detail.

According to FIG. 9, the 4:1-combiner (reference sign 33 of FIG. 4) comprises three couplers 91*a*, 91*b*, 91*c*, preferably hybrid-couplers, more preferably 90-degrees-hybrid-couplers, most preferably 90-degrees-hybrid-couplers with 3 dB. Each of said three couplers 91*a*, 91*b*, 91*c* is connected to a corresponding terminator 92*a*, 92*b*, 92*c*, preferably a corresponding terminator with 50 Ohm.

In this context, the first coupler 91*a*, especially the inputs thereof, is connected to the respective path of the first and the second sender or transmitter, respectively. Furthermore, the second coupler 91*b*, especially the inputs thereof, is connected to the respective path of the third and the fourth sender or transmitter, respectively.

Moreover, the first coupler 91*a*, especially the output thereof, and the second coupler 91*b*, especially the output thereof, are connected to the third coupler 91*c*, especially the inputs thereof.

As it can further be seen from FIG. 9, the switch matrix (reference sign 34 of FIG. 4) and the 1:8 splitter (reference sign 35 of FIG. 4) are exemplarily illustrated as a single unit, which comprises eight amplifiers 93*a*, 93*b*, 93*c*, 93*d*, 93*e*, 93*f*, 93*g*, 93*h*. Accordingly, each path with special respect to the sectors comprises the corresponding amplifier. Advantageously, each of the amplifiers 93*a* to 93*h* is switchable. In this context, the respective path or paths can be switched on or off.

Figure 10:
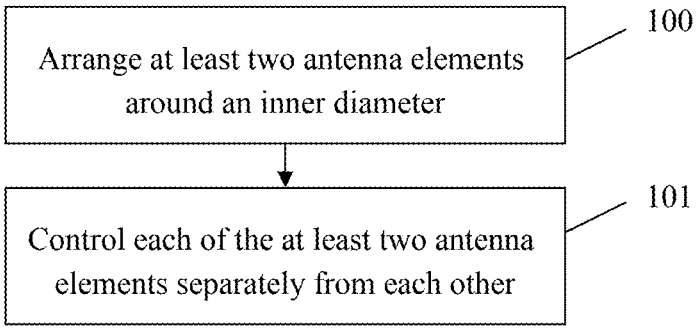
FIG. 10 shows a flow chart of an embodiment of the second aspect of the invention.

Finally, FIG. 10 shows a flow chart of an embodiment of the inventive antenna controlling method. In a first step 100, at least two antenna elements are arranged around an inner diameter. Then, in a second step 101, each of the at least two antenna elements is controlled separately from each other.

In this context, it might be particularly advantageous if each of the at least two antenna elements is configured to receive signals separately from each other. In addition to this or as an alternative, each of the at least two antenna elements may be configured to transmit signal separately from each other.

Furthermore, the method may comprise the step of employing at least two amplifiers, wherein each of the at least two antenna elements is connected to a corresponding one of the at least two amplifiers. In this context, it might be particularly advantageous if the number of the amplifiers is equal to the number of the antenna elements.

As an alternative to the step of employing at least two amplifiers, the method may comprise the step of employing a multi-channel amplifier, wherein each of the at least two antenna element is connected to a corresponding channel of the multi-channel amplifier.

In this context, it might be particularly advantageous if the number of channels of the multi-channel amplifier is equal to the number of the antenna elements. Moreover, the method may further comprise the step of arranging the at least two antenna elements around the inner diameter in a circular manner.

Furthermore, the method may further comprise the step of actively steering the respective beams of the at least two antenna elements. In addition to this or as an alternative, the method may comprise the step of supporting, preferably controlling, a direction finder unit especially being distant from the at least two antenna elements.

In this context, it might be particularly advantageous if the method comprises the step of detecting a receive signal direction by supporting, preferably controlling, the direction finder unit.

Furthermore, especially in transmission operation mode with respect to the at least two antenna elements, the method may advantageously comprise the step of rerouting the available transmission power of inactive antenna elements of the at least two antenna elements to active antenna elements of the at least two antenna elements.

In this context, it might be particularly advantageous if the method comprises the step of equally distributing the available transmission power to the active antenna elements. With respect to the at least two antenna elements, it is noted that it might be particularly advantageous if the method comprises the step of employing or arranging, respectively, four, preferably eight, antenna elements.

While various embodiments of the present invention have been described above, it should be understood that they have been presented by way of example only, and not limitation.

Numerous changes to the disclosed embodiments can be made in accordance with the disclosure herein without departing from the spirit or scope of the invention. Thus, the breadth and scope of the present invention should not be limited by any of the above described embodiments. Rather, the scope of the invention should be defined in accordance with the following claims and their equivalents.

Although the invention has been illustrated and described with respect to one or more implementations, equivalent alterations and modifications will occur to others skilled in the art upon the reading and understanding of this specification and the annexed drawings. In addition, while a particular feature of the invention may have been disclosed with respect to only one of several implementations, such feature may be combined with one or more other features of the other implementations as may be desired and advantageous for any given or particular application.

While various embodiments of the present invention have been described above, it should be understood that they have been presented by way of example only, and not limitation. Numerous changes to the disclosed embodiments can be made in accordance with the disclosure herein without departing from the spirit or scope of the invention. Thus, the breadth and scope of the present invention should not be limited by any of the above described embodiments. Rather, the scope of the invention should be defined in accordance with the following claims and their equivalents.

Although the invention has been illustrated and described with respect to one or more implementations, equivalent alterations and modifications will occur to others skilled in the art upon the reading and understanding of this specification and the annexed drawings. In addition, while a particular feature of the invention may have been disclosed with respect to only one of several implementations, such feature may be combined with one or more other features of the other implementations as may be desired and advantageous for any given or particular application.

What is claimed is:

1. An antenna system comprising:

at least two antenna elements, wherein the at least two antenna elements are arranged around an inner diameter, wherein each of the at least two antenna elements is configured to be controlled separately from each other, wherein the antenna system is configured to support a direction finder unit being distant from the antenna system and wherein in transmission operation mode, the antenna system is configured to reroute available transmission power of inactive antenna elements of the at least two antenna elements to active antenna elements of the at least two antenna elements.

2. The antenna system according to claim 1, wherein each of the at least two antenna elements is configured to receive signals separately from each other, and/or wherein each of the at least two antenna elements is configured to transmit signals separately from each other.

3. The antenna system according to claim 1, wherein the antenna system further comprises at least two amplifiers, and wherein each of the at least two antenna elements is connected to a corresponding one of the at least two amplifiers.

4. The antenna system according to claim 3, wherein the number of the amplifiers is equal to the number of the antenna elements.

5. The antenna system according to claim 1, wherein the antenna system further comprises a multi-channel amplifier, wherein each of the at least two antenna elements is connected to a corresponding channel of the multi-channel amplifier.

6. The antenna system according to claim 5, wherein the number of channels of the multi-channel amplifier is equal to the number of the antenna elements.

7. The antenna system according to claim 1, wherein the at least two antenna elements are arranged around the inner diameter in a circular manner.

8. The antenna system according to claim 1, wherein the antenna system is configured to actively steer the respective beams of the at least two antenna elements.

9. The antenna system according to claim 1, wherein the antenna system is configured to detect a receive signal direction by supporting the direction finder unit.

10. The antenna system according to claim 1, wherein the antenna system is configured to equally distribute the available transmission power to the active antenna elements.

11. The antenna system according to claim 1, wherein the antenna system comprises at least four antenna elements.

12. A method for controlling an antenna system, the method comprising:

arranging at least two antenna elements of the antenna system around an inner diameter, controlling each of the at least two antenna elements separately from each other, supporting a direction finder unit being distant from the antenna system, and rerouting, in transmission operation mode, available transmission power of inactive antenna elements of the at least two antenna elements to active antenna elements of the at least two antenna elements.

13. The method according to claim 12, further comprising:

receiving signals separately from each other with respect to each of the at least two antenna elements, and/or transmitting signals separately from each other with respect to each of the at least two antenna elements.

* * * * *